US005799587A

United States Patent [19]

Branch

[11] Patent Number: 5,799,587

[45] Date of Patent: Sep. 1, 1998

[54] PORTABLE DISPLAY CENTER

[76] Inventor: Jesse A. Branch, P.O. Box 1602, Greenville, N.C. 27835

[21] Appl. No.: 810,528

[22] Filed: Mar. 3, 1997

[51] Int. Cl.[6] ..... A47B 1/00

[52] U.S. Cl. ..... 108/66; 108/92

[58] Field of Search ..... 108/92, 115, 59, 108/64, 66; 297/174, 157.1, 159.1, 156, 158.1

[56] References Cited

U.S. PATENT DOCUMENTS

| | | | |
|---|---|---|---|
| 116,459 | 6/1871 | Lee | 108/92 |
| 573,960 | 12/1896 | Bruss | 108/92 |
| 2,476,535 | 7/1949 | Denson et al. | 108/92 |
| 3,452,985 | 7/1969 | D'Zmura | 108/66 |
| 5,027,718 | 7/1991 | Graham, Sr. | 108/64 |
| 5,363,772 | 11/1994 | Adamidis | 108/66 |

FOREIGN PATENT DOCUMENTS

| | | | |
|---|---|---|---|
| 226734 | 1/1925 | United Kingdom | 108/66 |

*Primary Examiner*—Peter M. Cuomo
*Assistant Examiner*—Gerald A. Anderson
*Attorney, Agent, or Firm*—Gipple & Hale

[57] ABSTRACT

A collapsible, portable event display counter if disclosed, whereby the supporting structure is easily folded into a unitary compact configuration. The support structure essentially comprises a central hub to which a plurality of elongated horizontal arms are radially attached. Each of the horizontal arms is provided with an upright shelf support for engaging the ends of encircling, removable shelves. Provision is also made for flooring and an overhanging umbrella or awning.

19 Claims, 10 Drawing Sheets

PORTABLE DISPLAY CENTER

SUMMARY OF THE INVENTION

The present invention is directed to a collapsible and portable event and/or display structure of the type having an enclosed configuration whereby personnel manning the device are essentially surrounded by a plurality of encircling shelves or display surfaces.

BACKGROUND OF THE INVENTION

In the world of marketing and commerce, display structures which are portable and which can be transported from one convention, event, or other location easily and quickly have become increasingly important in permitting manufacturers and sellers to display and exhibit their goods. Such structures can be useful in a large variety of situations for the serving and presentation of refreshments at various types of events and for demonstrative exhibits of various sorts.

Such collapsible and portable structures can be awkward and laborious to erect requiring a number of personnel and a considerable amount of time and energy which could otherwise be directed to more productive ends. This is especially true in "wrap-around" structures which encircle the personnel manning them. In the past, such structures have required large, bulky and difficult to transport shelving arrangements which, in addition to requiring considerable time and effort for erection have also required anchoring devices such as stakes or heavily weighted objects which can mar the underlying floor structure. Further, such structures, when not in use require large storage areas and considerable valuable transport space to move from one area to another. It is not uncommon, for example, to require a fork lift or similar device to move the component parts of display stands into position from the trucks bringing them to the desired location. Finally, such structures have often required numerous nails, bolts, or clamps to hold them together in a reasonably satisfactory manner and this in turn has necessitated the use of various tools and other implements for erecting the structure. There is, accordingly, the need for a fully portable, easily erectable, display or event system of the type which surrounds the operating personnel, which system can be transported and erected by a single individual without the need for additional implements or tools other than those of the most basic type. Further, there is a need for a display or event center of this type which can be used on any surface without requiring stakes or other anchoring devices and which will not harm the integrity of the surface on which the structure is placed.

DETAILED DESCRIPTION OF A PREFERRED EMBODIMENT

Figure 1:
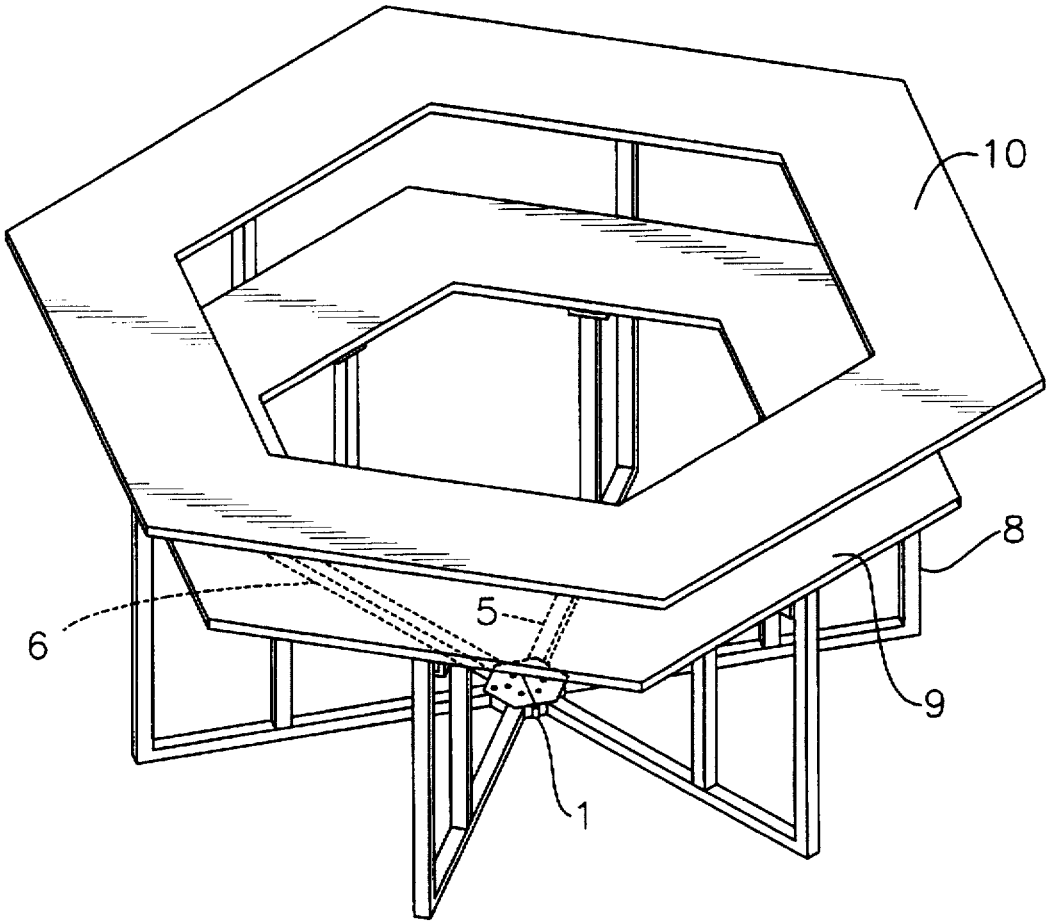
FIG. 1 is a front perspective view of an embodiment of the present invention without covering material or an overhead umbrella attached.

The present invention is directed to a fully portable collapsible display or event structure which comprises a central hub having a plurality of horizontally extending elongated arms which are each pivotally attached to one end to the central hub.

Each of the elongated arms extends radially from the hub in spaced relationship to one another and is provided at its other end with an upright support structure for a plurality of stacked shelves. Each support structure has a plurality of stacked horizontal support surfaces for supporting the end of one of the horizontal shelves which extend between and in engagement with pairs of these horizontal support surfaces to form a plurality of continuous shelf surfaces disposed circumferentially about the perimeter of the structure. It will, of course, be understood that one or more of the shelves and or support surfaces associated with these shelves can be omitted, for example, to provide egress to the interior of the structure. Each of the upright support structures comprises a plurality of upright members of unequal length which extend vertically in order of diminished length at spaced intervals along one of the elongated arms. A horizontal support extends from the upper terminus of each upright member to a point on the adjacent longer upright member to form the horizontal support surface with the upper end of the longest upright member being capped with a horizontal support.

The horizontal elongated arms which extend radially from the central hub also provide support for a floor, conveniently consisting of a series of triangular or "pie-shaped" sections which rest on these arms.

Of particular importance and significance in the present invention is the central hub to which the ends of the horizontally extending elongated arms are attached. The central hub essentially comprises two flat plates which are spaced horizontally apart from one another a sufficient distance to accommodate the respective end portions of the elongated arms. As will described further below, two opposing elongated arms are attached to the central hub, each at two points so that the position of each of these arms is fixed with respect to the hub and the two arms are in mutual co-linear alignment. The remainder of the horizontal elongated arms are attached to the central hub only at a single point disposed at spaced intervals between and on either side of the opposing co-linear support arms in fixed position. Thus, these remaining elongated arms are pivotally attached to the central hub so that they can be folded back in parallel with the two fixed arms to present a compact linear structure when the device is collapsed for transport and/or storage.

Additionally, it is a preferred feature of the present invention that the central hub be bisected transversely to the linear alignment of the folded back elongated arms to permit the entire linear structure to be collapsed on itself thereby reducing its total length to one-half. This is conveniently accomplished by placing a hinge on the side of the central hub at the point where to two bisecting halves converge.

The complete structure of a preferred embodiment of the device of the invention will, however, be more fully appreciated by having specific reference to the drawings which illustrate in detail the device of the invention in a preferred and exemplary form.

Figure 2:
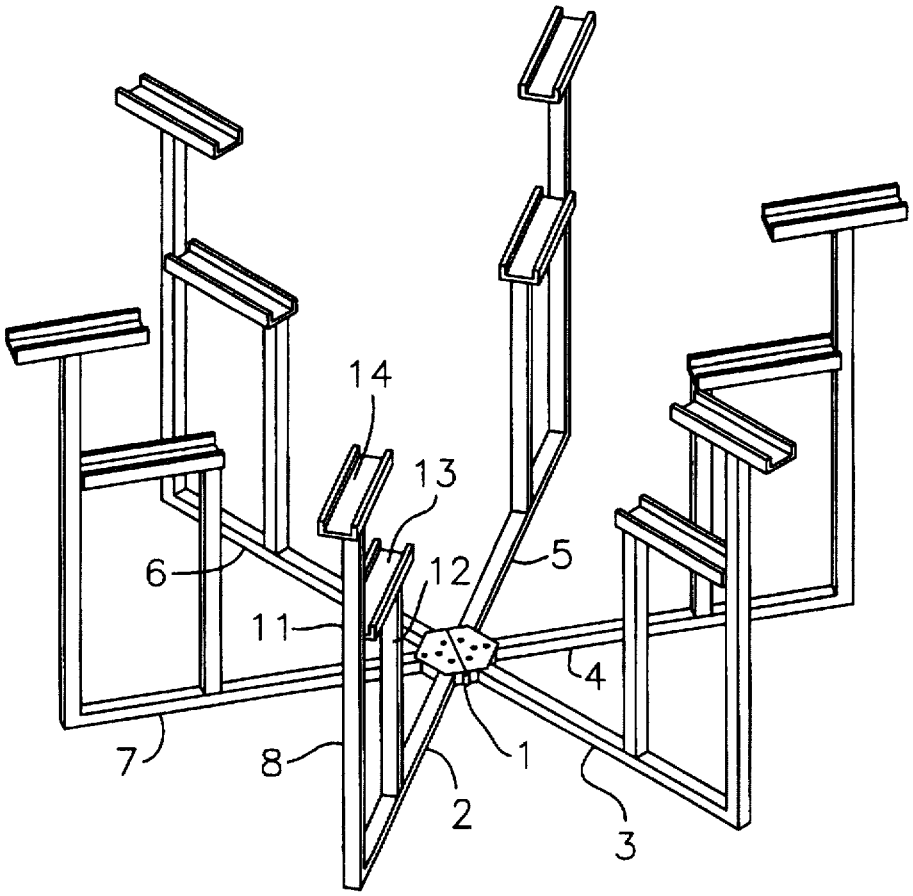
FIG. 2 is a front perspective view of the erected structure of the invention with the shelves removed.

Directing attention to FIGS. 1 and 2 of the drawings, it will be seen that a plurality of horizontal, elongated arms 2 through 7 extend radially from a central hub 1. Although not illustrated in FIGS. 1 and 2 of the drawings, elongated arms 4 and 7 are fixedly attached at two points each to the central hub 1 so that they are maintained in constant, fixed linear alignment with one another. The remaining elongated arms 2, 3, 5 and 6 are attached to the central hub 1 only by a single bolt so that they are pivotable and can be folded back towards the arms 4 and 7. As particularly shown in FIG. 2 of the drawings, each of the horizontal, elongated arms 2 through 7 has attached to its distal end an upright support structure. Typical of these upright support structures is structure 8 disposed at the end of elongated arm 2. Support structure 8 consists of a longer vertical standard 11 attached at the distal end of elongated arm 2 and a shorter vertical standard 12 disposed radially inward on horizontal arm 2. Engaging the top end of standard 12 is horizontal support surface 13 which is attached at an intermediate point on elongated upright standard 8. This horizontal support surface 13 along with similar horizontal support surfaces disposed on the remaining horizontal arms, as shown in the drawings, provide the support for the lower level of shelving 9 shown in FIG. 1 of the drawings. Conveniently, the horizontal support surfaces 13 are provided with upright sides or projections which engage with slots (not shown) on the underside of the respective shelves to provide more secure attachment. Each of the longer upright standards 8 disposed at the ends of the respective horizontal arms is topped by a similar horizontal support surface 14 for accommodating and supporting the layer of shelves 10 illustrated in FIG. 1 of the drawings. It will also be noted in FIG. 2 of the drawings that hooks can be provided on the upright standards 8 to facilitate the hanging of vertical drapery or other similar material.

Figure 3:
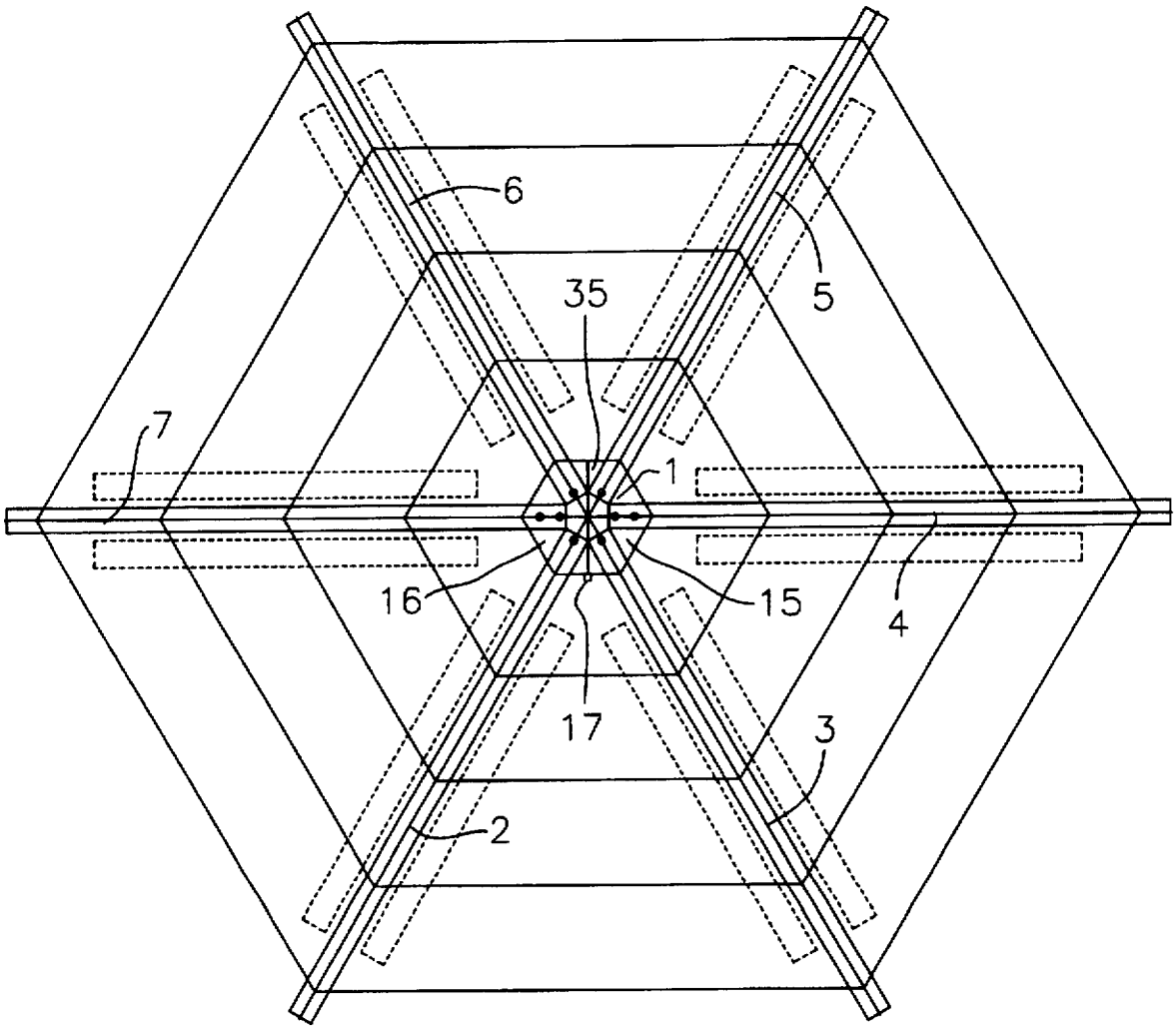
FIG. 3 is an overhead plan view of the floor structure of the invention including floor boards mounted on the radially extending arms.
Figure 4:
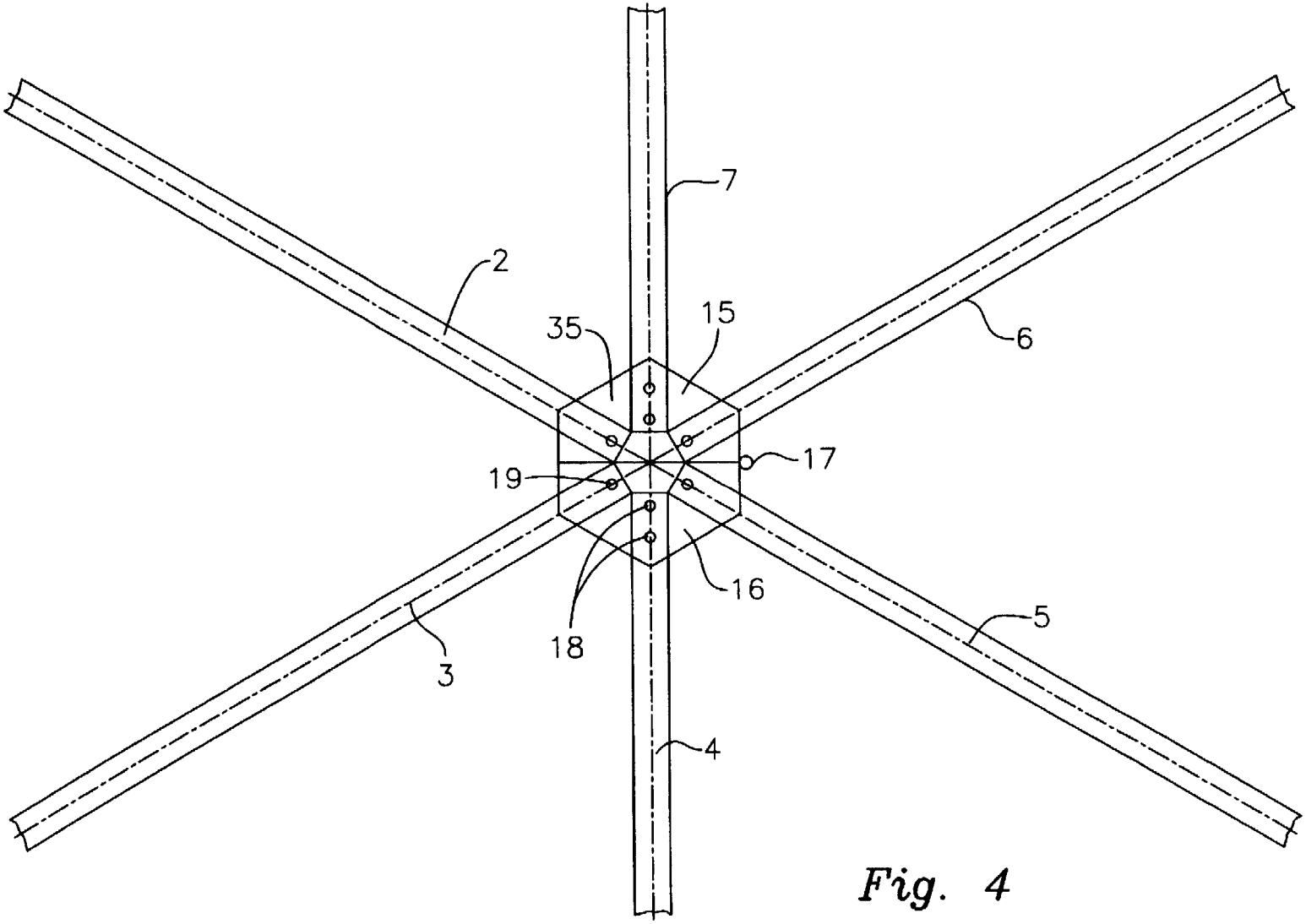
FIG. 4 is an overhead plan view illustrating attachment of the radial support arms to the central hub of the structure of the invention.
Figure 5:
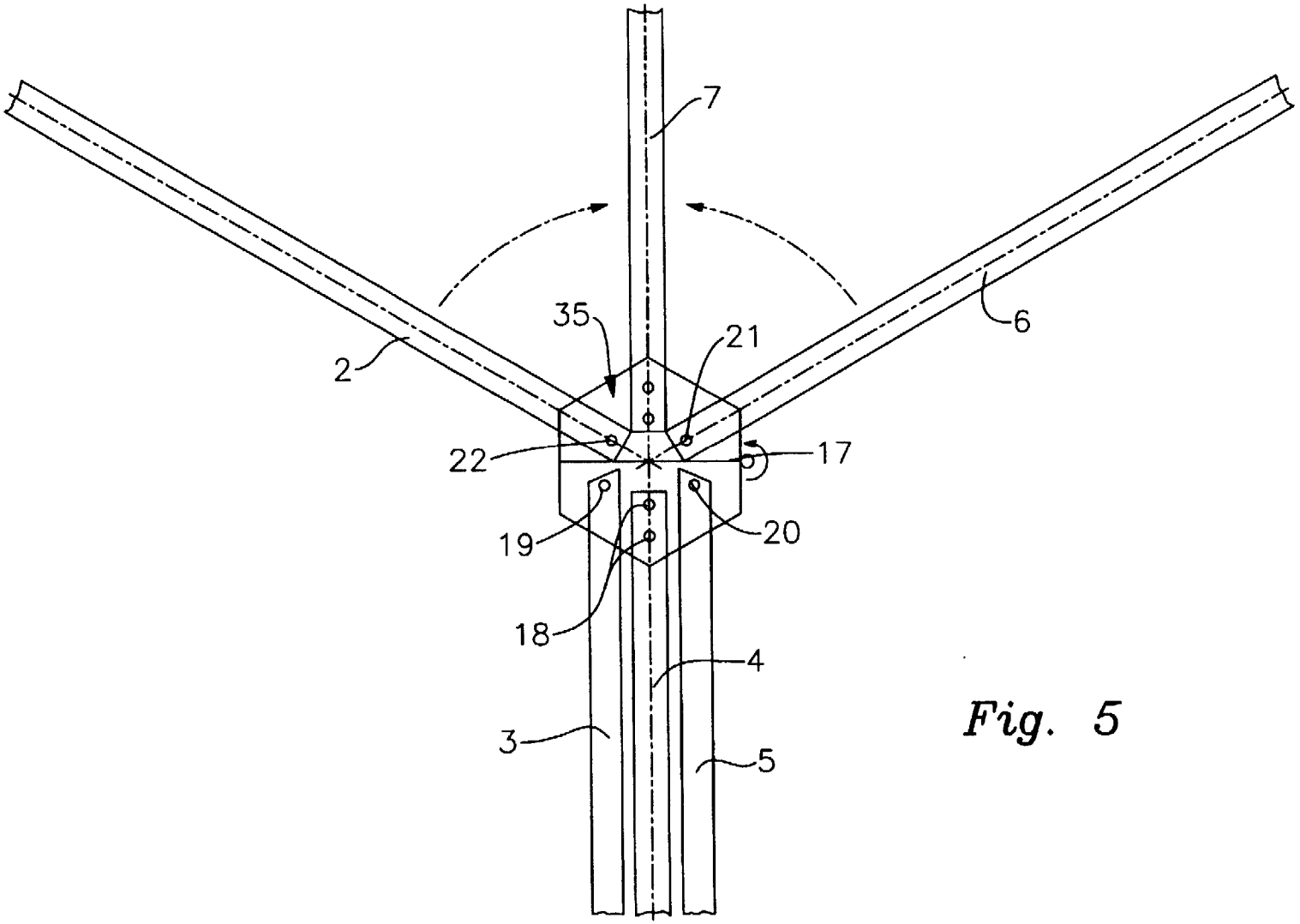
FIG. 5 illustrates the manner in which the radially support arms of the invention are folded into a linear configuration when the device of the invention is collapsed.

FIG. 3 of the drawings illustrates further the attachment of horizontal elongated arms 2 through 7 to the central hub 1. As will be clear from FIG. 6 of the drawings, the central hub 1, in fact, consists of top plate 35 and a bottom plate 26. FIG. 3 of the drawings illustrates the top plate 35 which is divided transversely to the elongated arms 4 and 7 into sections 15 and 16 which are held together by vertical hinge 17 at the edge of hub 1. As further seen in the drawings, flooring sections have been placed over the extending elongated arms 2 through 7 to provide a floor surface for the entire structure. FIG. 4 of the drawings illustrates in greater detail the attachment of the elongated arms 2 through 7 with the central hub 1. As shown in FIG. 4, arms 4 and 7 are actually attached by two bolts each so that they are held in rigid linear alignment with one another. The remaining arms 2, 3, 5 and 6 are held by only a single bolt or pin to permit folding of these arms into parallel alignment with arms 4 and 7 as illustrated in FIG. 5 of the drawings. As shown in FIG. 5 of the drawings, horizontally extending elongated arms 3 and 5 have been folded on their respective pivot points 19 and 20 to be in parallel alignment with fixed horizontal extending arm 4. When the device is collapsed for storage or transportation, it will, of course, be understood that horizontal elongated arms 2 and 6 are folded in a similar manner into parallel arm alignment with fixed arm 7.

Figure 6:
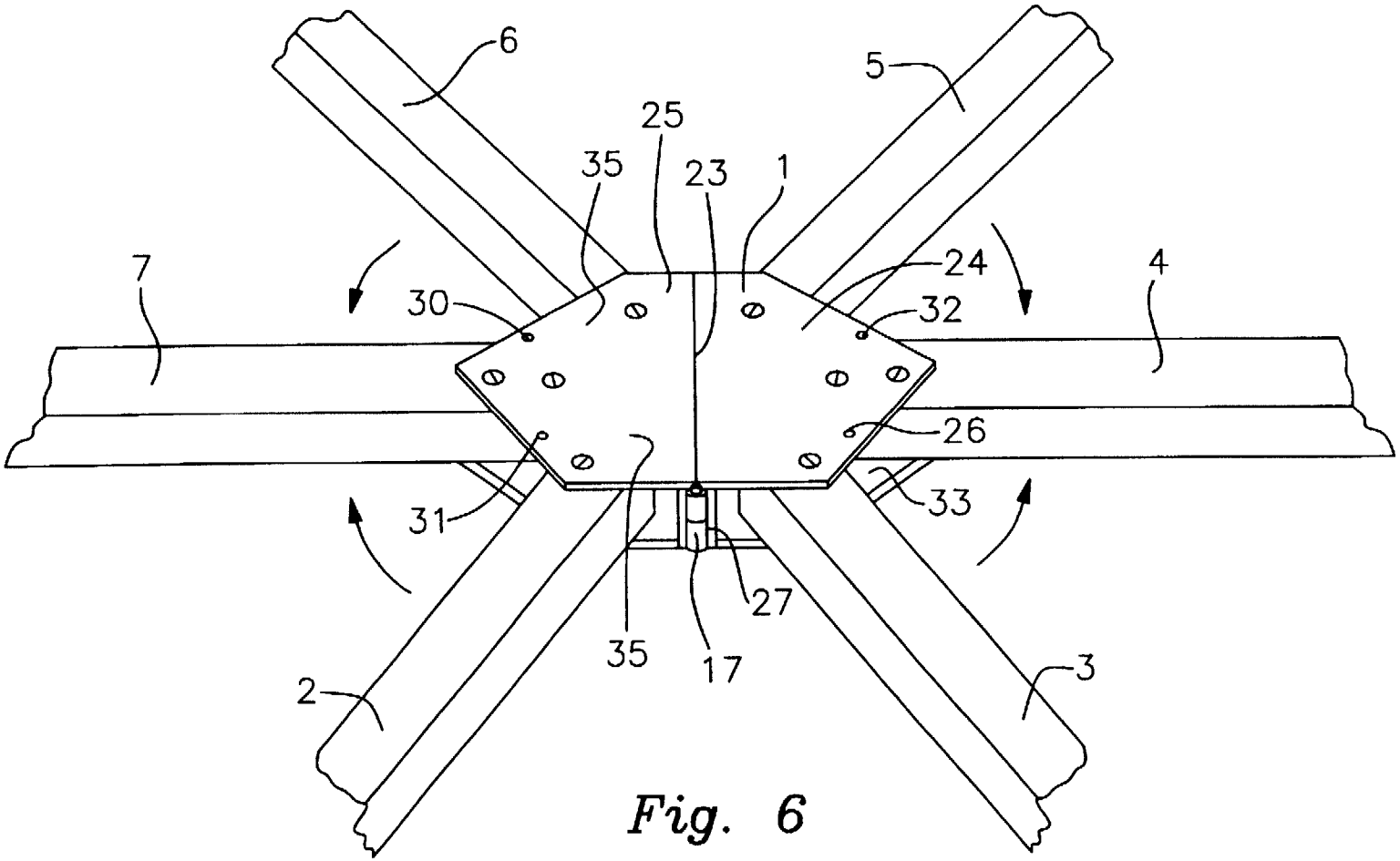
FIG. 6 is a front perspective view illustrating attachment of the radial support arms of the invention with the central foldable hub.
Figure 7:
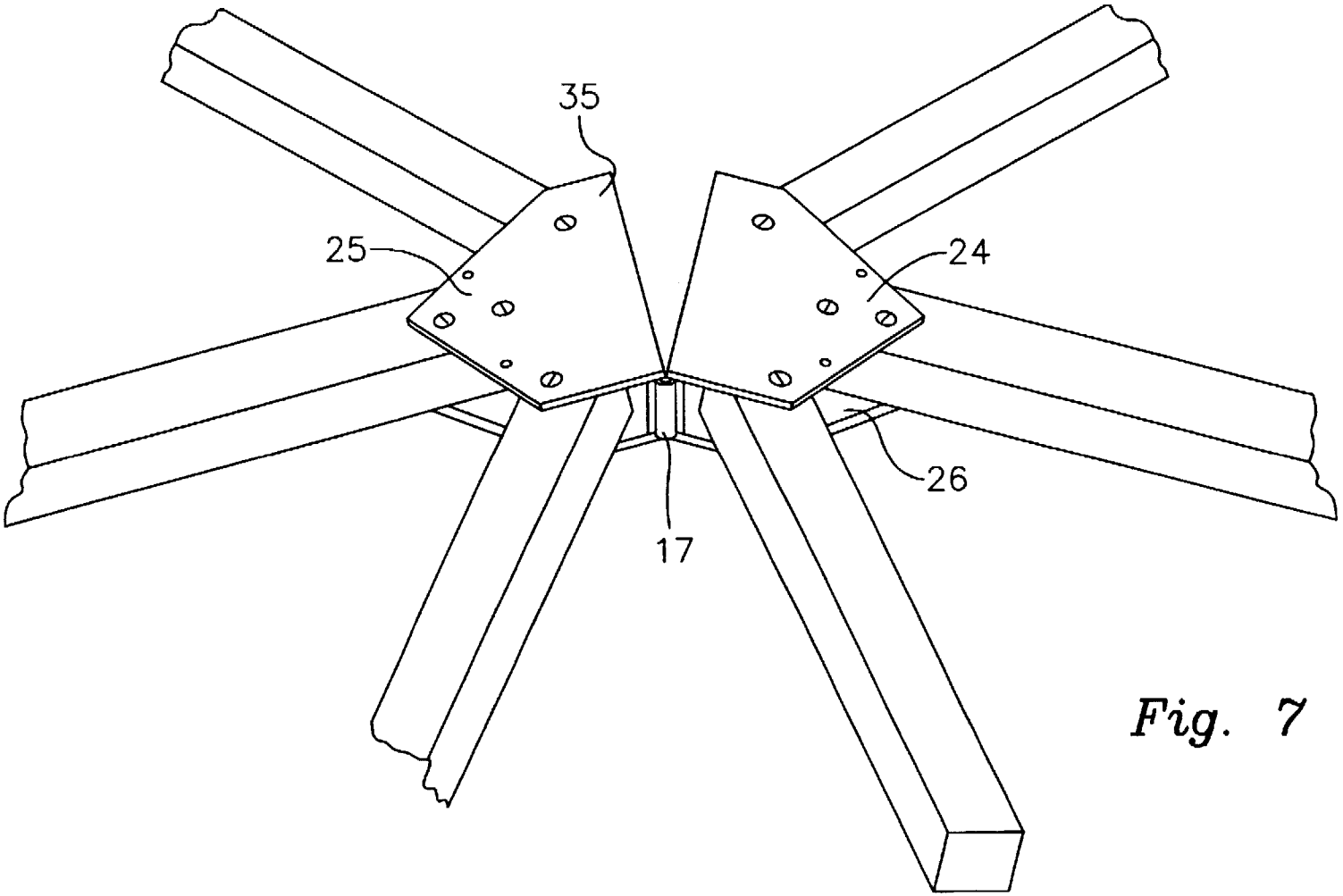
FIG. 7 illustrates the hinged construction of the central hub to which the radial arms are attached.

Directing attention to FIG. 6 of the drawings, it will be seen that central hub 1 comprises top plate 35 and bottom plate 26 having a essentially the same dimensions and disposed in spaced parallel relationship to accommodate the ends of the horizontal elongated arms 2 through 7. Each of the plates 35 and 26 is divided at 23 into two sections. On either side of the division 23, a pair of plates 27 are conveniently attached on opposing sides of the hub 1 to maintain the correct separation and orientation of the plates 26 and 35. A hinge 17 is provided joining the two plates 27 so that the two halves 24 and 25 of the hub can be separated as illustrated in FIG. 7 of the drawings. Although not shown in the drawings, a pair of plates similar to 27 are disposed on the opposing side of hub 1 on either side of division 23 but not connected by a hinge. FIG. 7 of the drawings illustrates how the central hub 1 is separated and folded back so that the entire structure of the invention is further collapsed into a more compact arrangement. It will, of course, be appreciated that prior to actually disengaging the two halves 24 and 25 of central hub 1, the elongated arms 2, 3, 5 and 6 would normally be folded back into parallel alignment with the two fixed arms 4 and 7. Complete opening of the central hub permits, for example, arms 3, 4 and 5 to be folded back into parallel alignment alongside arms 2, 6 and 7 thereby forming a much more compact structure for transportation and storage.

Figure 8:
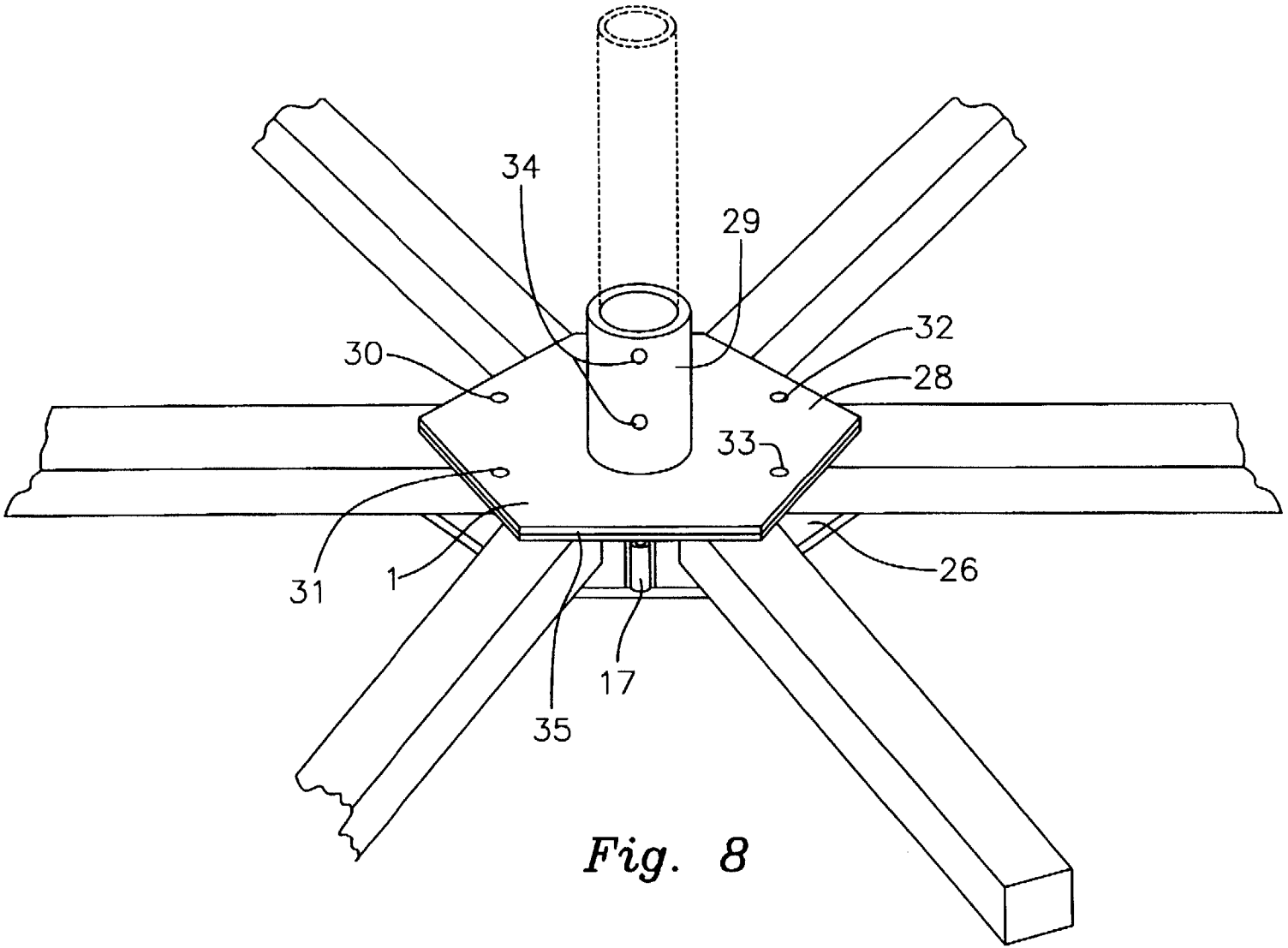
FIG. 8 illustrates attachment of the an additional hub plate with socket for attachment of an umbrella or other centrally disposed structure.
Figure 9:
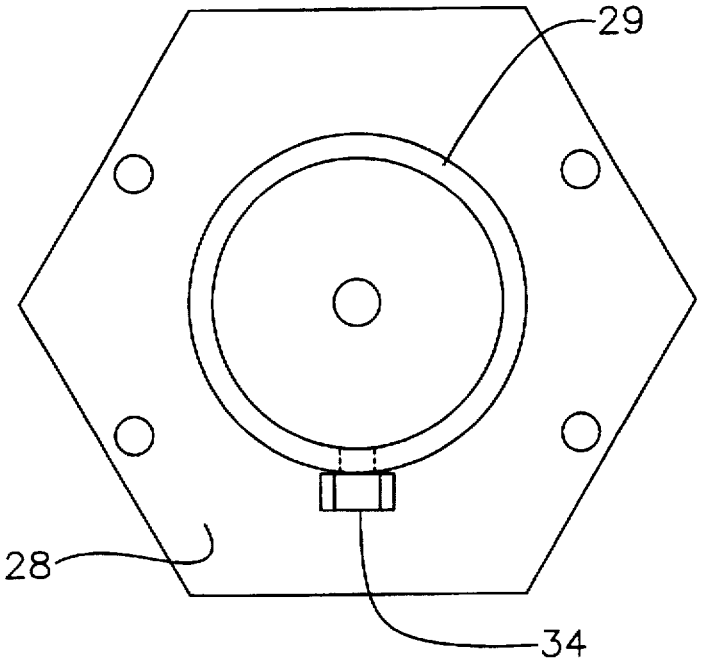
FIG. 9 is an overhead plan view of the plate and socket for attaching an overhead shaft bearing an umbrella.
Figure 10:
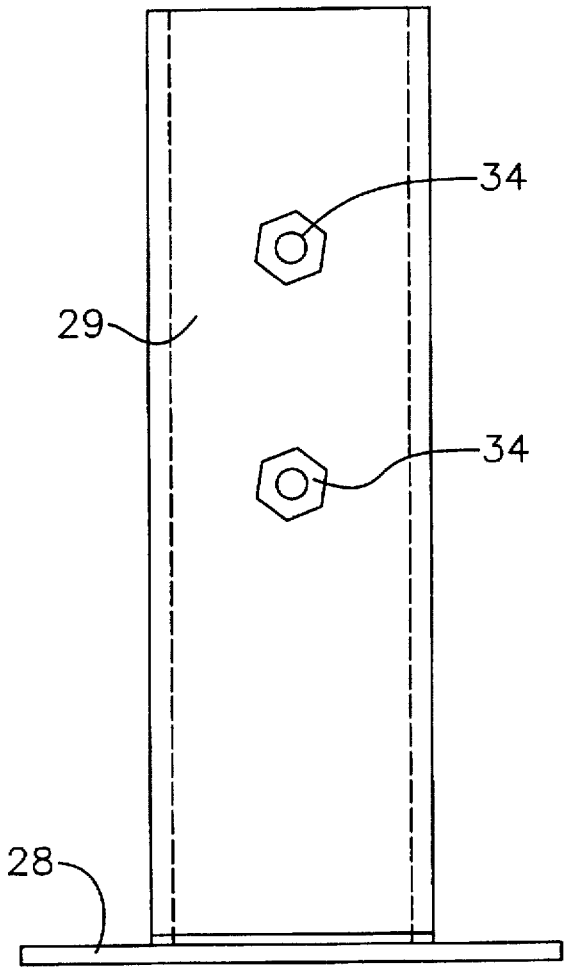
FIG. 10 is a side plan view of the socket and plate for attaching an upright structure to the central hub.
Figure 11:
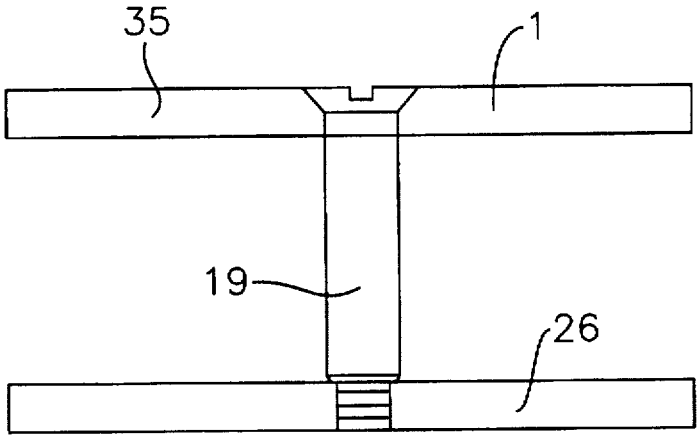
FIG. 11 is a side partial view illustrating the manner in which top and bottom plates are attached in spaced relationship to form the central pivotal hub of the invention.

FIG. 8 of the drawings illustrates attachment of an additional plate 28 having essentially the same dimensions as central hub 1 to the top of central hub 1 by means of bolts placed in holes 30 through 33. This plate essentially consists otherwise of a vertically mounted socket 29 of appropriate dimensions to accommodate the shaft of an umbrella or other structure shown in phantom in the drawings. Lock nuts 34 are provided to secure the shaft in the socket 29. FIG. 9 of the drawings is a top view showing in greater detail plate 28, socket 29 and the top most of the lock nuts 34. Similarly, FIG. 10 is a side plan view showing plate 28 with socket 29 vertically attached to it and the two lock nuts 34 for securing of the shaft. FIG. 11 of the drawings illustrates the manner in which recessed threaded bolt 19 is employed to engage top plate 35 with bottom plate 26. It will, of course, be understood that, as shown for example in FIG. 5 of the drawings, bolt 19 is but one of the bolts used to pivotally attach to the central hub the four moveable elongated arms 3, 5, 6 and 2. Similar recessed threaded bolts 18 are used for attachment of the fixed elongated arms 4 and 7 to the central hub.

It will, of course, be appreciated that while a preferred embodiment of the present invention has been described above, the invention contemplates a number of variations which are considered to fall within the scope of the invention. For example, more or fewer elongated arms can be employed in accordance with the invention and there is no requirement that the central hub have the illustrated hexagonal configuration only. Further, the number and arrangement of shelves or other display surfaces can be altered in accordance with particular needs of the situation. For example, it may be desirable to omit a section of shelving to provide an opening in the structure for egress to the interior. It will yet further be appreciated that the support standards and surfaces attached to the elongated arms can themselves be altered somewhat in structure in accordance with the present invention, for example, by providing collapsible or disengageable structures to further facilitate transportation and storage of the device.

Essentially, all that is required to erect the structure of the invention from its collapsed, disassembled configuration, is to unfold the elongated arms and central hub so that the structure shown in FIG. 2 of the drawings is formed and then add the desired shelving and flooring. If an overhanging umbrella or other centrally disposed upright structure is desired, the mounting plate and socket are easily bolted to the central hub to accommodate this structure. Drapes can be easily and readily attached around the perimeter to form a skirt. Reversal of these procedures results quickly and easily in disassembly into compact, easy to transport and store components which are immediately available for erection and use elsewhere.

What is claimed:

1. A portable, collapsible display structure comprising a central hub with a plurality of horizontal extending elongated arms each attached at one end thereof to one of a plurality of spaced points on said hub radially and positioned with respect to the center thereof; each of said arms extending radially from said hub and being provided with an upright support structure having a plurality of stacked horizontal support surfaces each for supporting the end of a horizontal shelf; a plurality of said horizontal shelves extending between and in engagement with adjacent pairs of said support surfaces to form a plurality of continuous shelf surfaces disposed circumferentially about the perimeter of said display structure.

2. The display structure of claim 1 wherein each of said upright support structures comprises a plurality of upright members of unequal length extending vertically in order of diminished length at spaced intervals along one of said arms from the circumference of the structure, a horizontal support extending from the upper terminus of each upright member to a point on the adjacent, longer upright member to form said horizontal support surface with the upper end of the longest upright member being capped with a horizontal support member.

3. The display structure of claim 1 wherein said elongated arms project radially from said hub at equidistantly spaced intervals.

4. The display structure of claim 1 wherein a plurality of flat panels are disposed on said horizontal arms to form a floor for said structure.

5. The display structure of claim 1 wherein there are six of said elongated arms.

6. The display structure of claim 1 wherein said central hub comprises two flat plates spaced horizontally apart from one another a sufficient distance to accommodate the respective end portions of said arms.

7. The display structure of claim 6 wherein two of said elongated arms each extend co-linearly outward from opposite sides of said hub in fixed positions.

8. The display structure of claim 7 wherein each of the remaining of said elongated arms are pivotally attached at intervals to said hub between said two opposing co-linear arms such that each can be folded into parallel alignment with one of said co-linear arms.

9. The display structure of claim 6 wherein said plates are each bisected into a coextensive pair of halves which are joined together by a common hinge which extends vertically between said plates at the edge of said hub.

10. The display structure of claim 1 wherein said central hub is provided with a centrally disposed, vertically extending socket for accommodating a vertical pole.

11. The display structure of claim 1 wherein said central hub is bisected across its surface into two halves which are joined at one edge of the hub by a hinge.

12. A portable, collapsible display structure comprising a central hub comprising two flat plates spaced horizontally apart from one another a sufficient distance to accommodate a plurality of horizontal extending elongated arms each attached at one end thereof to one of a plurality of spaced points on said hub and radially and positioned with respect to the center thereof; two of said elongated arms each extending co-lineary outward from opposite sides of said hub in fixed positions and each of the remaining plurality of elongated arms being pivotally attached at intervals to said hub between said two opposing co-linear arms so that each can be folded into parallel alignment with one of said co-linear arms; each of said arms extending radially from said hub and being provided with an upright support structure having a plurality of stacked horizontal support surfaces each for supporting the end of a horizontal shelf; a plurality of said horizontal shelves extending between and in engagement with adjacent pairs of said support surfaces to form a plurality of continuous shelf surfaces disposed circumferentially about the perimeter of said display structure.

13. The display structure of claim 12 wherein each of said upright support structures comprises a plurality of upright members of unequal length extending vertically in order of diminished length at spaced intervals along one of said arms from the circumference of the structure, a horizontal support extending from the upper terminus of each upright member to a point on the adjacent, longer upright member to form said horizontal support surface with the upper end of the longest upright member being capped with a horizontal support member.

14. The display structure of claim 13 wherein said elongated arms project radially from said hub at equidistantly spaced intervals.

15. The display structure of claim 14 wherein a plurality of flat panels are disposed on said horizontal arms to form a floor for said structure.

16. The display structure of claim 15 wherein there are six of said elongated arms.

17. The display structure of claim 12 wherein said central hub is bisected across its surface into two halves which are joined at one edge of the hub by a hinge.

18. The display structure of claim 12 wherein said central hub is provided with a centrally disposed, vertically extending socket for accommodating a vertical pole.

19. The display structure of claim 12 wherein said plates are each bisected into a coextensive pair of halves which are joined together by a common hinge which extends vertically between said plates at the edge of said hub.

* * * * *